United States Patent [19]

Kosbab

[11] 4,210,330

[45] Jul. 1, 1980

[54] MODULAR BROADHEAD ARROWHEAD

[75] Inventor: John V. Kosbab, Toledo, Ohio

[73] Assignee: Dynamic Sports concepts, Inc., Toledo, Ohio

[21] Appl. No.: 877,327

[22] Filed: Feb. 13, 1978

[51] Int. Cl.[2] ..... F41B 5/02

[52] U.S. Cl. ..... 273/106.5 B

[58] Field of Search ..... 273/106.5 B

[56] References Cited

U.S. PATENT DOCUMENTS

| | | | |
|---|---|---|---|
| 2,940,758 | 6/1960 | Richter | 273/106.5 B |
| 3,868,114 | 2/1975 | Groner | 273/106.5 B |
| 3,910,579 | 10/1975 | Sprandel | 273/106.5 B |
| 3,915,455 | 10/1975 | Savora | 273/106.5 B |
| 4,036,499 | 7/1977 | Sherwin | 273/106.5 B |
| 4,050,696 | 9/1977 | Troncoso, Jr. | 273/106.5 B |
| 4,099,720 | 7/1978 | Zeren | 273/106.5 B |

*Primary Examiner*—Paul E. Shapiro
*Attorney, Agent, or Firm*—Hugh Adam Kirk

[57] ABSTRACT

A solid arrow shaft front extension portion or ferrule having a plurality of offset slots parallel to tangents to the shaft for replaceable and interchangeable devices or blades of general triangular or other shape held at their forward end in the slots by an interchangeable screw-in tip and at their rearward end by a deformable collar urged into locking the devices in position by screwing of the rear shank of the shaft extension or arrowhead into the front socket of the arrow shaft. If desired, between the collar and the end of the arrow shaft there may be provided one or more weight washers and/or a resilient locking washer for adjusting the angularity of the blades with respect to the nock at the rear of the arrow shaft.

31 Claims, 28 Drawing Figures

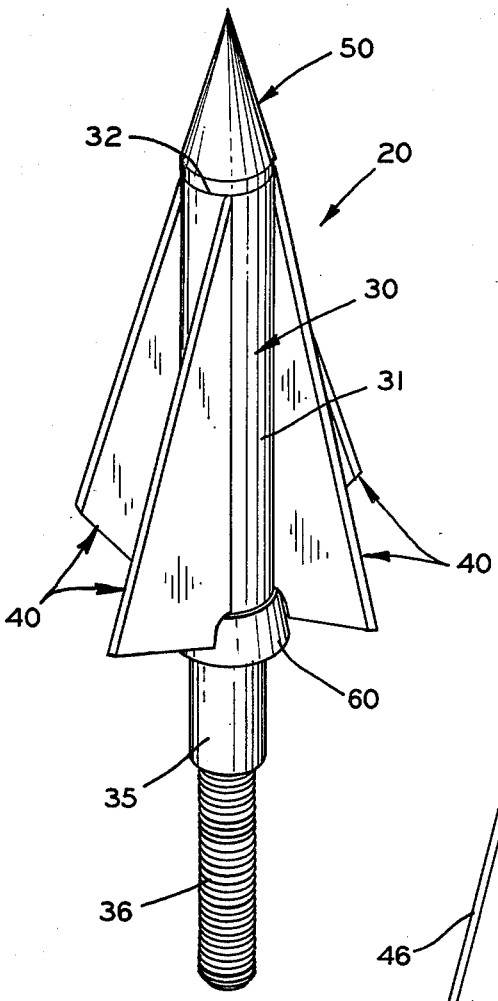
FIG. I
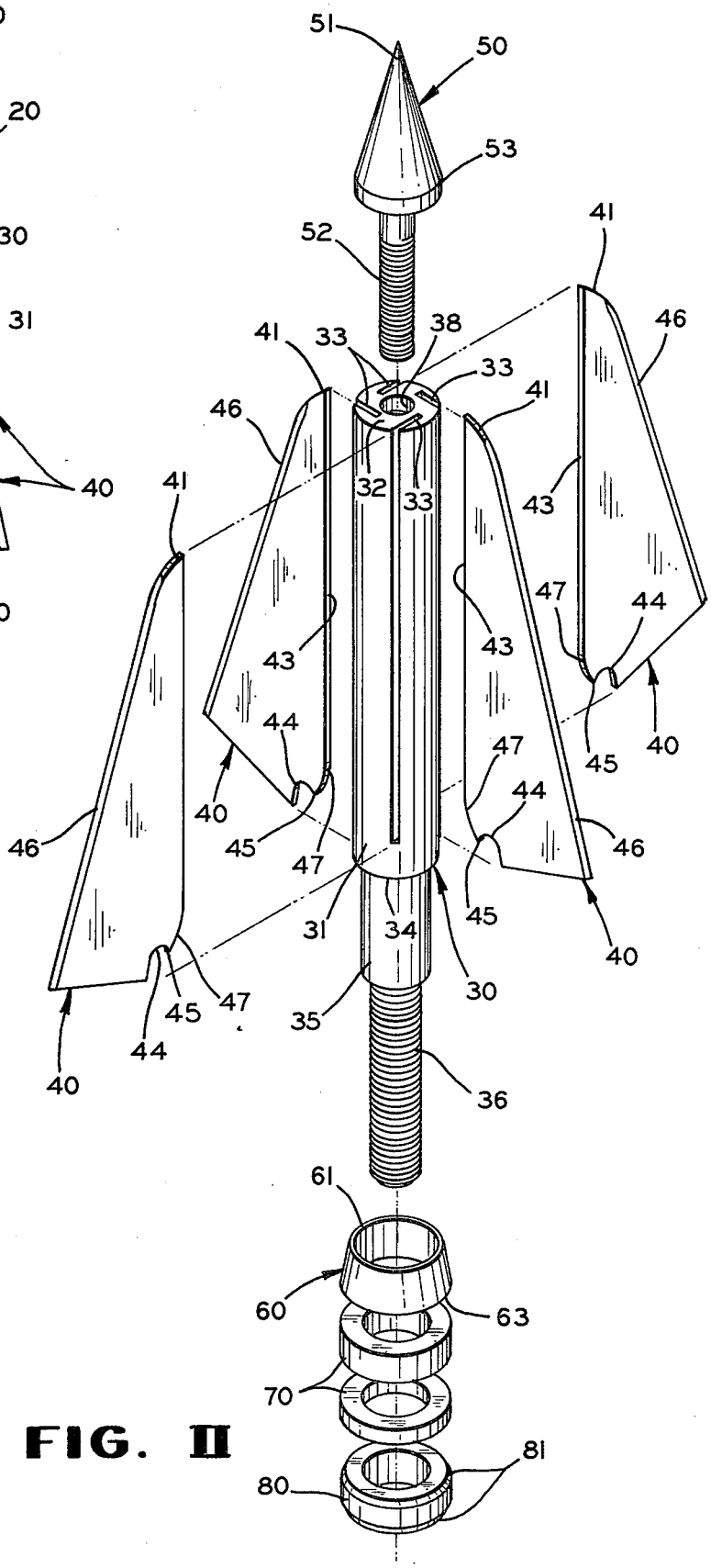
FIG. II

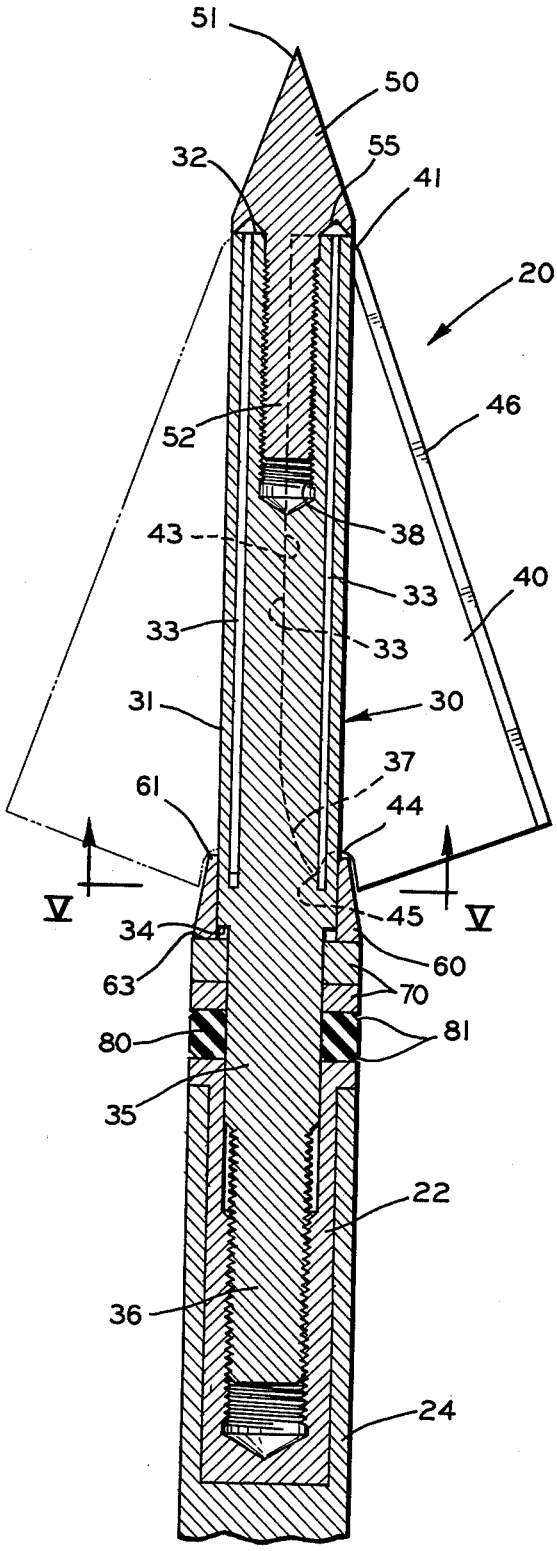
FIG. III
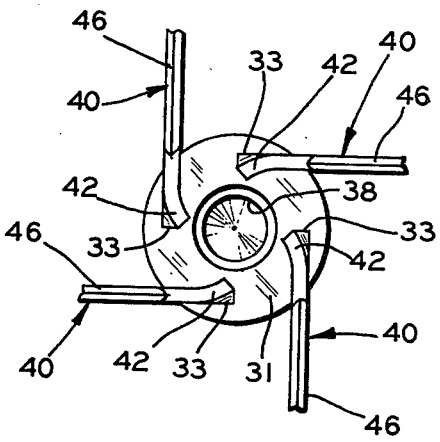
FIG. IV
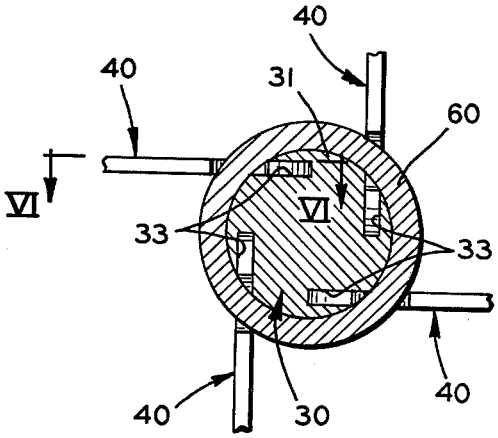
FIG. V
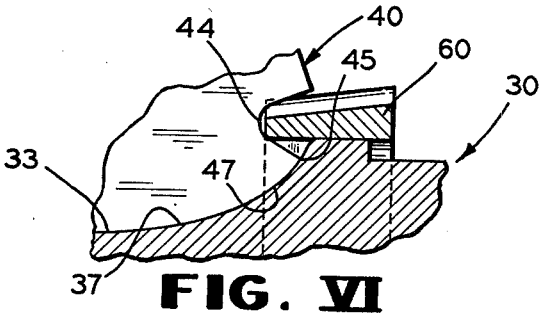
FIG. VI

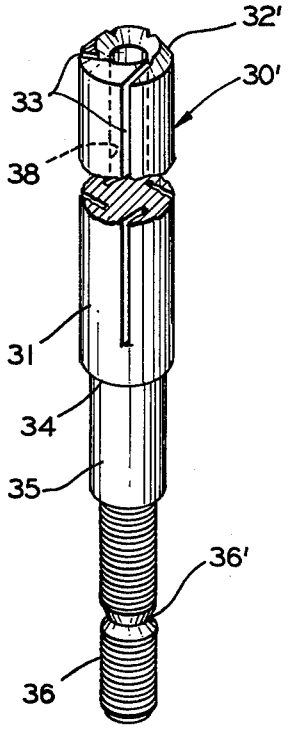
FIG. VIII
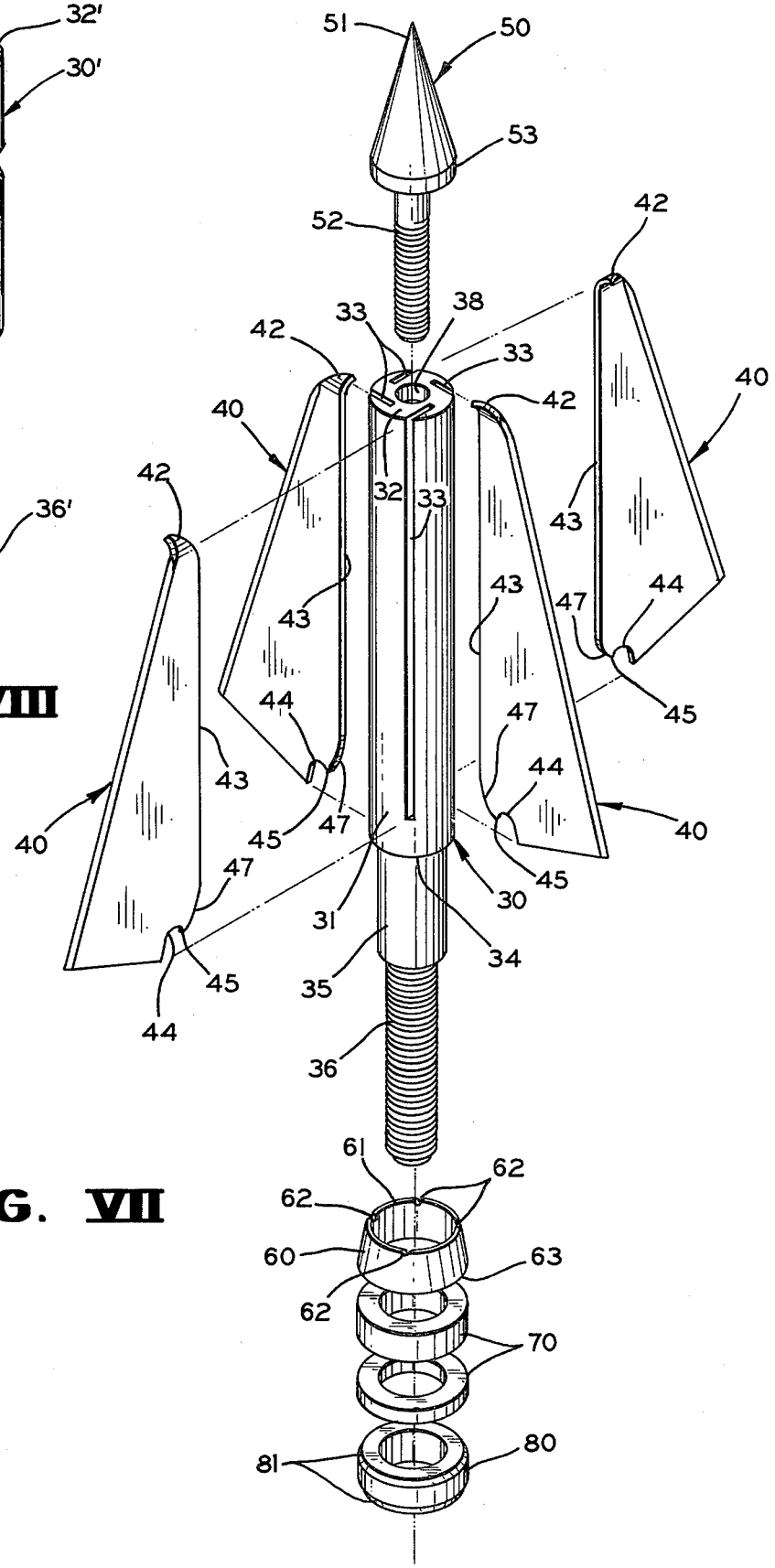
FIG. VII

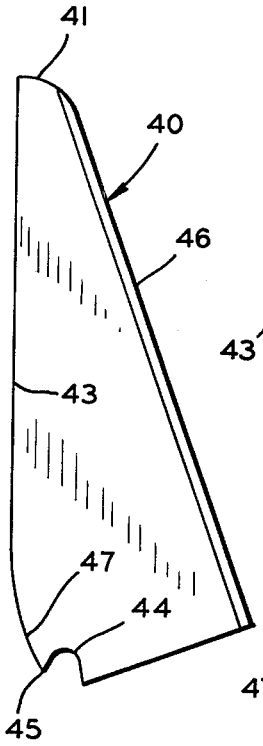
FIG. IX
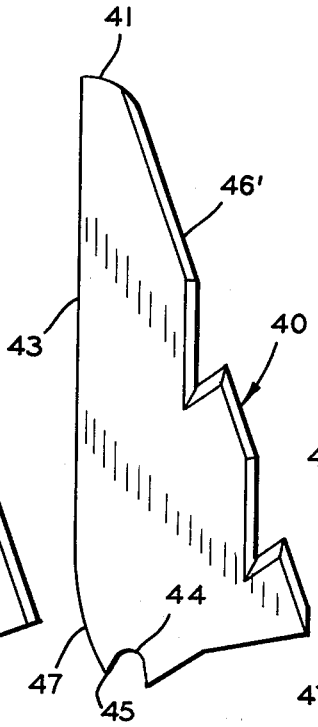
FIG. X
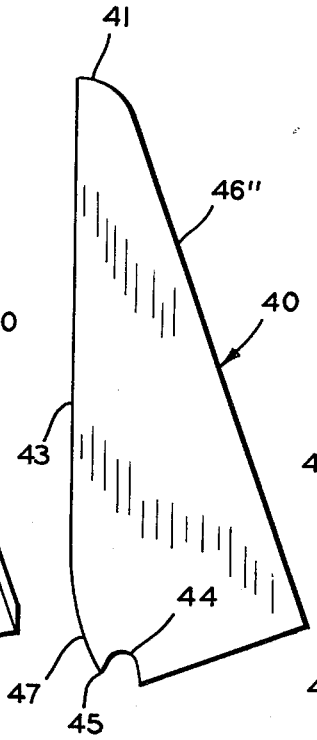
FIG. XI
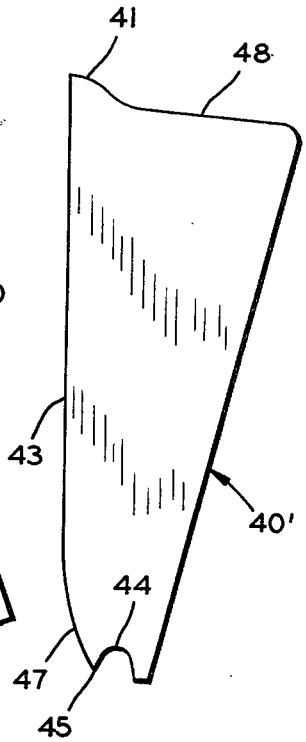
FIG. XII
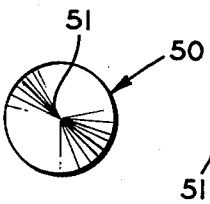
FIG. XIX
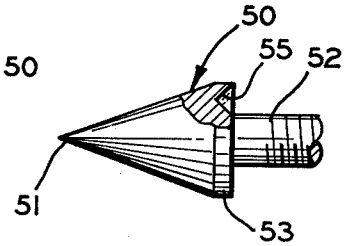
FIG. XX
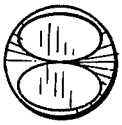
FIG. XXI
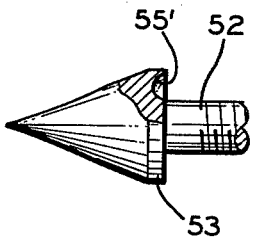
FIG. XXII
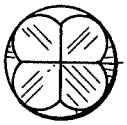
FIG. XXIII
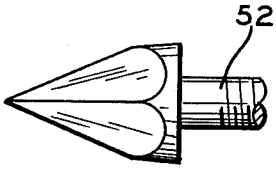
FIG. XXIV
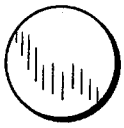
FIG. XXVII
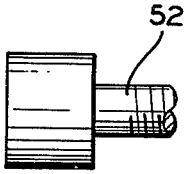
FIG. XXVIII
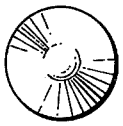
FIG. XXV
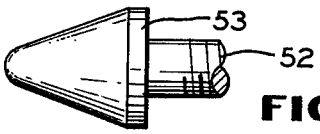
FIG. XXVI

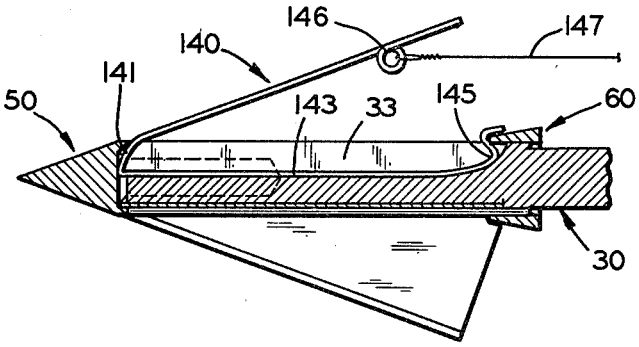
FIG. XIII
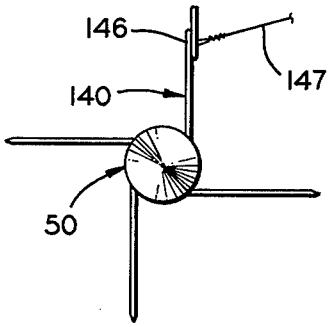
FIG. XIV
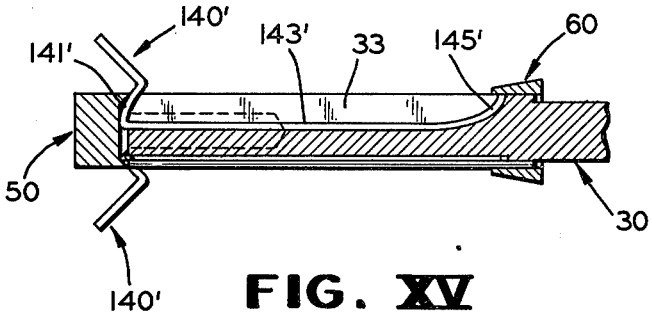
FIG. XV
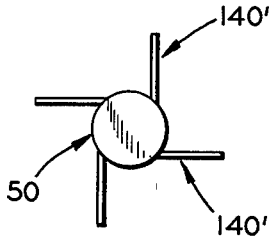
FIG. XVI
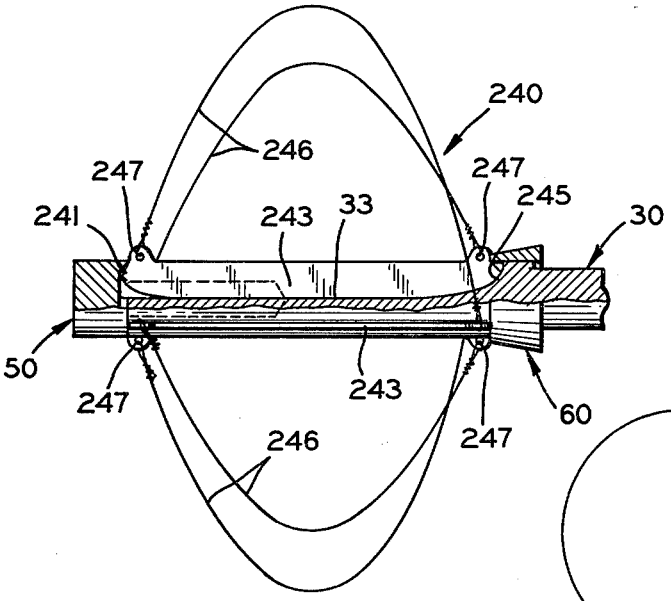
FIG. XVII
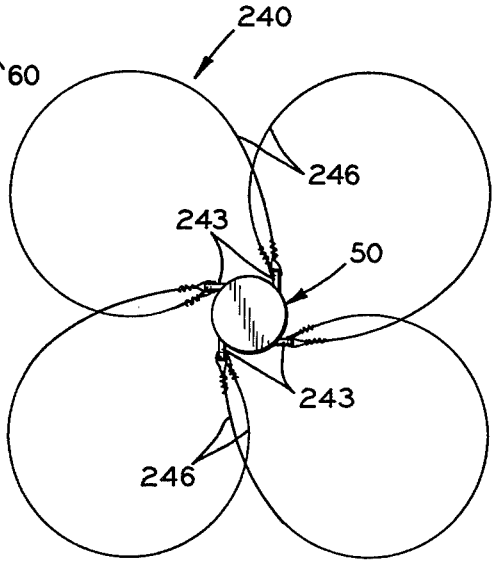
FIG. XVIII

MODULAR BROADHEAD ARROWHEAD

BACKGROUND OF THE INVENTION

Although broadhead arrowheads with replaceable blades are known as shown in Richter U.S. Pat. No. 2,940,758 issued June 14, 1960 and Sherwin U.S. Pat. No. 4,036,499 issued July 19, 1977, such blades were held at their ends into radial slots which are limited in their depth by the radius of the shaft portion, and the deeper the slots, the weaker the shaft portion. Such limited depth radial slots also limit the size of the blades and outside diameter of the arrowhead which in turn limits the effectiveness of the damage the arrowhead can inflict, particularly in hunting larger animals having large and hard bones that shatter weakly constructed arrowheads.

Although arrows having offset blades, that is blades in planes tangent to the cylindrical surface of the arrow shaft, are known in Ramsey U.S. Pat. No. 2,589,137 issued Mar. 11, 1952, there is no known broadhead arrowhead which has replaceable offset blades or wire devices in offset slots in the arrowhead ferrule or shaft extension portion.

Furthermore, the employment of washer-type weights and flexible resilient washers on hand-thrown darts are known in Kurtz et al U.S. Pat. No. 3,957,271 issued May 18, 1976, but such weights and/or flexible locking-type washers are not known to have been employed for varying the balance, static inertia, spine weight, and tuning of arrow shafts and/or adjusting the angularity and locking of the blades with an arrow shaft.

SUMMARY OF THE INVENTION

Generally speaking, the broadhead arrowhead of this invention comprises a solid central shaft portion or ferrule having longitudinal slots for seating triangular-shaped blades, wires or other devices, which slots are offset radially from central axis thereof in planes parallel to tangents to the circumference of the shaft portion.

These offset slots for the blades and wires unexpectedly increase the flight stability of the arrow as well as increase the arrow's resistance to wind planing over that for radially mounted blades and wires. Furthermore, such offset blade devices have improved penetration characteristics so that they may twist the arrow when one blade strikes a harder object, such as a bone or a tree, reducing the damage to both the arrow and the object struck. Thus, a new improved and unobvious relationship is created by applicant's broadhead arrowheads with the arrow shafts upon which they are used.

The front or forward end of the shaft portion is provided with an internally threaded socket for replaceable tips, which tips have annular grooves or trepans for locking the front acute angled ends of the blades or devices in their slots.

The rear end of the central shaft portion is provided with an axially extending shank portion which is externally threaded at least at its outer end, for engagement into a threaded socket at the forward end of the arrow shaft. Between the forward end of the arrow shaft and the rear of the blades, wires, or devices, there is provided a frusto-conical deformable collar which is pressed and deformed to lock into the rear end of each of the blades or devices to hold each individually, which is done by screw-tightening of this arrowhead.

if desired, between this deformable collar and the front end of the arrow shaft, there may be provided one or more different-size weight washers for adjusting the balance, tuning, static inertia and spine weight of the arrow. These weights by increasing the static inertia of the front end of the arrow, unexpectedly and dramatically affect the flexibility of the arrow shaft, i.e. its spine weight. Thus the tuning of the arrow when delivered by the bow's energy to the rear of the arrow shaft, greatly increases the accuracy of the arrow.

Preferably also a resilient locking washer may be inserted between the deformable collar and front end of the arrow shaft, which permits angular adjustment of the blades or devices with respect to the nock at the rear end of the arrow shaft for ease in sighting the arrow, as well as resists the easy unscrewing of the arrowhead from the front end of the arrow shaft preventing vibrations of the arrow in its flight from loosening it on the arrow shaft.

Different size and shape blades, wires or other devices may be interchanged and/or new blades or devices replaced into the arrowhead by the easy disassembly of the parts of this arrowhead. These devices may comprise triangular or other shaped blades with outer straight or notched cutting edges or unsharpened different angular diverging edges, or they may comprise wires or strips with wires or other means attached to the strips. Nevertheless, all of the devices are provided with acute angle projections at opposite ends of their bases which seat in the slots; the projection at the forward end locking in the groove or trepan in the tip, and the projection at the rearward end being which projection may be accentuated by an adjacent notch for engagement by the deformable collar. Since the slots in the central shaft portion may be reduced in depth at their rearward ends to approach the cylindrical surface of the shaft portion, the lower or seating edges of the bases of each of the devices may be correspondingly configured to accurately fit into these slots with their rear notches at the outer cylindrical surface of the shaft portion.

The tips are provided with rearwardly externally threaded shank portions which screw into the internally threaded forward ends of the solid shaft portions or ferrules of the broadhead arrowhead. These tips may comprise different types of points such as conical, chisel-shaped, pyramid-shaped, blunt, rounded, cylindrical-shaped, or any others. The rear end of each of these tips adjacent and surrounding the threaded shank portions is provided with an annular groove, into which groove the forward acute angle projections of the bases of the devices seat and may be bent transversely as their projections are pressed into this groove by the screw tightening of the arrowhead onto the arrow shaft, thus further and positively locking the front ends of the devices into their slots in the shaft section.

OBJECTS AND ADVANTAGES

It is an object to produce an efficient, effective, economic, simple, versatile, adjustable, strong, stable, tough, durable broadhead arrowhead which resists wind-planing, flies fast and straight, and has good penetration without breaking when it hits a hard object.

Another object is to produce such a broadhead arrowhead with easily replaceable and interchangeable blades which are individually locked in place and may have sharp cutting edges that may bend without breaking and splintering, and which cutting edges produce long cuts in the flesh of the animal hit therewith to promote profuse bleeding for quicker, more humane kills.

Another object is to produce such a broadhead arrowhead with easily replaceable and interchangeable hardened tips which resist bending, breaking and smearing.

Another object is to produce such a broadhead arrowhead which can be easily varied in balance, spine weight, and tuning according to the desires of the hunter, and can have its blades adjusted with respect to the angle of the nock at the rear of the arrow shaft for ease in sighting and to resist wind-planing.

BRIEF DESCRIPTION OF THE VIEWS

The above mentioned features, objects and advantages, and a manner of attaining them are described more specifically below by reference to embodiments of this invention shown in the accompanying drawings wherein:

FIG. I is an enlarged side and front perspective view of an assembled broadhead arrowhead according to one embodiment of this invention;

FIG. II is an enlarged exploded view of the parts of the broadhead arrowhead shown in FIG. I ready for assembly;

FIG. III is an enlarged longitudinal sectional view of an assembled arrowhead according to the embodiment shown in FIGS. I and II;

FIG. IV is a further enlarged front end view with the point or tip removed showing how the front acute angled ends of the blades may be bent and locked into the tip;

FIG. V is an enlarged cross-sectional view taken along lines V—V of FIG. III showing the deformable locking collar engaged in the notches at the rear ends in the blades for individually locking the rear ends of the blades;

FIG. VI is a sectional view taken along line VI—VI of FIG. V showing how the deformable collar engages the rear notches in the blade for wedging the rear ends of the blades into their slots;

FIG. VII is an exploded disassembled view similar to FIG. II showing how the blades and collar can be deformed after tight assembly on an arrow shaft;

FIG. VIII is a perspective view of another embodiment of the central shaft portion, with a part broken away, for the broadhead arrowhead according to this invention, showing a crater-shaped front end and an annularly grooved rear end threaded portion;

FIGS. IX through XII show four different forms of blades, namely straight, notched, unsharpened and blunt, respectively, each with a slot seating hypotenuse side or base edge of the same configuration with acute angle projections at each end thereof;

FIGS. XIII and XIV show a longitudinal section and front view respectively of another embodiment of a broadhead arrowhead according to this invention in which a V-shaped wire replaces at least one of the blades, to which wire is attached a fish line;

FIGS. XV and XVI show a longitudinal section and front view, respectively, of another embodiment of a wire device in the offset slots of the broadhead arrowhead of this invention;

FIGS. XVII and XVIII show a longitudinal section and front view, respectively, of still another embodiment of still another type of wire loop device; and FIGS. XIX through XXVIII show respectively end and side views of five different types of tips that may be employed at the forward end of the broadhead arrowhead, namely conical, chisel, pyramidal, rounded, and blunt tips, with FIGS. XX and XXII having parts broken away to show two different types of annular grooves in their bases.

DETAILED DESCRIPTION OF PREFERRED EMBODIMENTS

Referring first to FIGS. I, II and III, the broadhead arrowhead assembly 20 shown in FIG. I screws into an internally threaded ferrule 22 of an arrow shaft 24 (see FIG. III). The principle parts of this broadhead arrowhead 20 are: a central solid cylindrical shaft portion or ferrule 30 (or 30', see FIG. VIII) which may be considered as a forward extension of the arrow shaft 24; a plurality of replaceable blades 40, 40' or wire or other devices 140, 140', 240, (see FIGS. XIII through XVIII); a screw-in tip 50; and a rear deformable collar 60, between which collar and the front end of the arrow shaft 24 or socket ferrule 22 may be inserted one or more weight washers 70 and/or preferably a resilient locking washer 80.

A. The Shaft Portion

Referring first specifically to the solid central cylindrical shaft extension portion 30 or 30', it comprises a forward longitudinal larger diameter cylindrical portion 31 (see FIG. II) with a flat or other shaped end, such as crater-shaped (see FIG. VIII), groove contoured forward end 32 or 32', respectively, and with at least one and preferably a plurality, herein four, equally angularly spaced slots 33 which extend from the forward end face 32 or 32' to short of the rear shoulder 34 of the larger portion 31. Extending rearwardly and integrally with this cylindrical portion 31 is a coaxial shank portion 35, at least the outer end of which is threaded as shown at 36 with threads which correspond and fit the standard ferrules 22 employed at the forward end of most arrow shafts 24. This threaded portion may have an intermediate circumferential groove 36' (see FIG. VIII) so that its outer end may be easily broken off for fitting into sockets 22 of lesser depth and still be able to clamp its shoulder 34 and/or washers 70 and 80 against the forward end of the socket 22 or arrow shaft 24.

Attention is called to the fact that the rear end 37 of each of the slots 33 reduce in depth to strengthen the ferrule 30 and to counteract the impact force that tends to slide the blades rearwardly, and also to tighten the rear of the blades into their retaining collar 60. This reduction 37 in depth of the slots 33 may be arcuate as shown in dotted lines in FIGS. III and VI. The base or hypotenuse of each of the triangular blades 40 or devices 140, 140' and 240 that fits into the slot 33 is correspondingly contoured or curved at its rear end 45, 145, or 245 to conform therewith. An important feature of this invention is that the slots 33 are in planes parallel to tangents to the surface of the cylinder portion 31, and are not radial slots with respect to the axis of this cylinder portion 31, thus permitting these slots 33 to be deeper than radial slots and still retain strength and rigidity in the shaft portion 30 as well as the whole broadhead arrowhead 20. Thus the planes of each of the slots 33 are offset radially from the central axis of the shaft portion 30 or 31 and the slots may even be deeper than shown in FIGS. IV and V.

The forward flat end of the cylindrical portion 31 is provided with an internally threaded axially aligned socket 38 into which different tips 50 are easily attached by screwing into this socket 38.

B. The Blades or Devices

If more than one blade 40 or 40' or device 140, 140' and 240 are employed on one arrowhead, they are generally, but not always, all of equal size and shape. Herein the blades 40 are triangular in shape and are four in number, one in each of four equally angular spaced slots 33 as shown in FIGS. I through III. The front or forward end of each blade 40, 40' or device 140, 140' and 240 has an acute angle projection 41, 141 and 241 of about 20° which may be slightly rounded or contoured to fit snugly and accurately at its angle in the groove 55 or 55' in the tip 50 when it projects beyond the flat surface 32 at the front end of the shaft portion 31. During and after assembly of these blades 40, 40' and devices 140, 140' and 240 in a flat-ended 32 ferrule 30, their projecting portions 41, 141 and 241 on the front ends of their bases in the offset slots 33 may become bent to form portions 42 as shown in FIGS. IV and VII due to their being forced or jammed at a transverse angle into the V-shaped or other contoured groove 55 or 55' (see FIGS. III, XX and XXII) at the base of each of the tips 50. However, the front projections 41, 141 and 241 of the bases of the blades 40, 40' or devices 140, 140' and 240 may fit accurately into the crater-shaped end 32' (see FIG. VIII) of the ferrule 30' and then no bending of their projections 41, 141 and 241 occurs.

The rear end of each blade or device base 40, 40', 140, 140' and 240 that fits into the slots 33, is contoured or rounded at 47 as previously mentioned, to fit the contoured rounded rear ends 37 of the slots 33, but at this rear end of each of their bases 43, 143 and 243 there is an acute angle projection 45, 145 and 245 (see FIGS. VI, XIII, XV, and XVII) which seats inside rear end 37 of the slot 33 and is wedgingly held therein by the forward end of the collar 60. In the blades 40 and 40' this projection 45 is adjacent a notch 44 so that the forward end of the collar 60 substantially completely fills and fits into and presses inwardly against the tapered side of these notches 44 (see FIG. VI).

The longer side of the two right angle adjacent sides of the triangular blades 40 in the embodiment shown in FIGS. I through IX have a sharpened edge 46. However, this sharpened edge 46 also may be curved, notched, or serrated as the edge 46' shown on the blade in FIG. X, or this side 46" may be unsharpened as shown in FIG. XI. Another form of the triangular blade 40' may be the reverse of those shown in FIGS. IX, X and XI, namely with the forward edge 48 being the shorter side of the triangular blade, and not be sharpened as shown in FIG. XII, thus forming a blunt arrowhead for stunning rather than cutting, particularly used in the hunting of small game. Preferably these blunt blades 40' are also used in combination with the blunt tips shown in FIGS. XXV through XXVIII.

An important feature of this invention is that the blades 40, although they have very sharp edges 46 or 46', some of the temper or hardness is the blades may be taken out so that they can bend such as into the position 42 shown in FIG. VII without breaking. This ability to bend also has the unexpected advantage that when the blades hit a hardened object, such as a bone in a larger animal, they will not splinter or break, and disperse metal splinters in the meat which could damage the mouth of the person that eats the meat.

Instead of the blades 40, 40', other devices 140, 140' and 240, such as wire as shown in the embodiments in FIGS. XIII and XVIII, may be used in the offset slots 33 of the broadhead arrowhead of this invention. For example, a V-shaped wire 140, the outer leg of which may have a loop 146 for a fish line 147, may be substituted for one or more of the blades 40 or 40'. This wire has acute angled projections 141 and 145 at its forward and rearward ends for locking engagement, respectively, with the annular grooves 55 and 55' in the tips 50, and under the front ends of the deformable sleeve 60.

FIGS. XV and XVI show another embodiment of a wire device 140' having similar features for anchoring into the slots 33 as that described for the embodiment shown in FIGS. XIII and XIV, and may be used for hunting small animals by stunning them similar to the blunt blade 40' shown in FIG. XII.

FIGS. XVII and XVIII disclose still another wire-type device such as for hunting birds in which loops, such as of piano or other wire or filament, 246 are anchored in holes 247 at opposite ends of metal base strips 243, which strips 243 are locked in the offset slots 33 at their acute angle projecting forward and rearward ends 241 and 245, respectively, by the grooves 55 or 55' in the tip 50, and under the front end of the deformable sleeve 60. These wire loops 240 may be fastened at one end in the hole 247 at the front end of one strip 243 and in the hole 247 at the rear end of the next adjacent strip 243.

Since the blades 40, 40' and wire devices 140, 140' and 240 are easily slidable into and out of the slots 33, this broadhead arrowhead 20 may be easily assembled and diassembled so that its blades and/or devices can be interchanged easily with blades and/or devices of other types. However, if the forward acute angled ends 41, 141 or 241 of the blades or devices are bent as shown in FIGS. IV and VII, or the blades are dull, they should be replaced.

C. The Tips

The tip 50 in the embodiments shown in FIGS. I, II, III, VII, XIII, XIV, XIX and XX comprises a conical point 51 at the base or rear end of which cone or tip 51 there axially extends an externally threaded shank or bolt-like portion 52 of lesser diameter than the base 53 of the conical point portion 51. This threaded shank 52 screws into the socket 38 of ferrule 30. The base 53 has formed therein an annular groove 55 or 55' of V-shaped or semi-circular radial cross-section (see. FIGS. XX and XXII), respectively, into which groove or trepan 55 or 55' the points 41, 141 or 241 at the front ends of the blades or device extend, or into which grooves 55 and 55' the crater-shaped or convex front end 32' of the ferrule 30' extends and fits. If the ferrule 30 has a flat or concave forward end 32, these points 41, 141 and 241 may be bent in the space of the groove 55 or 55', as shown at 42 in FIGS. IV and VII when forced therein. This bending occurs because of the offset angular projection into these grooves 55 and 55' after the blades 40, 40' or devices 140, 140' and 240 are assembled in FIG. III. Thus, not only do the grooves 55 and 55' seat the outer ends 41, 141 and 241 of each of the blades 40, 40' and devices 140, 140' and 240, but also may deform them to further lock them from sliding or being wedged out of their respective slots 33 and seats.

In FIGS. XIX through XXVIII, there are shown two views of examples of five different types of tips 50 which may be employed at the forward end of the broadhead arrowhead 20. They are the conical type shown in FIGS. XIX and XX, a chisel-type shown in FIGS. XXI and XXII, a pyramid-type shown in FIGS. XXIII and XXIV, a blunt rounded-type shown in FIGS. XXV and XXVI, and a blunt flat-type shown in FIGS. XXVII and XXVIII. Each of these particular types is provided with a groove 55 or 55' as shown in FIGS. III, XX, and XXII for anchoring and locking the forward tip ends 41, 141 and 241 of the blades 40, 40' and other devices 140, 140' and 240, which are used therewith.

Another important and unexpected feature of this invention is that the blades 40 or other devices 140, 140' and 240 are pushed forward by the retainer collar 60 into the annular grooves 55 or 55' of the tips 50 to compress and lock the parts 41, 141, 141', and 241 into the tips 50 to prevent the tips 50 from loosening or becoming unscrewed from the ferrule shaft 30.

D. The Collar

At the rear end of the cylindrical shaft portion 31 and easily fitting thereover, is a deformable frusto-conical collar 60, such as of aluminum, which collar preferably has a conical outer face which smoothly fills in the annular shoulder between the outside smaller diameter of this shaft extension portion 31 and the outside larger diameter of the arrow shaft 24 (see FIG. III) to aid the penetration of the arrowhead. The forward tapered rim 61 of this collar 60 also snugly fits into and substantially fills on a bias each of the notches 44 of the blades 40, 40' after they have been assembled into their slots 33 and may overlap or fit into the rear acute angle projections 45, 145 and 245 so as to hold and lock these blades 40, 40' and the devices 140, 140' and 240 in their slots 33. Then when the arrowhead assemblies as now shown in the different embodiments in FIGS. I, XIII, XV and XVII are screwed into the socket ferrules 22 at the front ends of arrow shafts 24 and tightened, the forward ends of the arrow shafts press directly against the rear annular sides 63 of the collars 60 forcing their forward ends 61 over the angled edge of the rear projections 45, 145 and 245 (see FIG. VI) to force and further lock the blades and devices into their seating slots 33, even to the deforming of the collar 60 to form notches 62 therein (see FIG. VII) corresponding to each of the blades 40, 40' or devices 140, 140' and 240. Thus an even, more positive individual locking of these blades 40, 40' and devices 140, 140' and 240 is obtained. This deforming and wedging action is increased further upon impact of the arrowhead with an object, thus still further locking the blades and devices in their slots to prevent their loosening when they struck the object.

E. The Weights

If desired, there may be provided rings of brass or other material, such as the metal washers 70, which may be slipped onto the shank portion 35 of the shaft portion 30 to add more weight to the arrowhead. None, one or more weights way be added to this shank 35 for the desired tuning of the arrow in this manner. These weights may vary in thickness or weight, such as for example 5 grains and 10 grains, enabling more flexibility in the adjustment of the balance, spine weight, and flexing characteristics of the arrow, all of which affect the accuracy of the arrow.

F. The Angle Lock Washer

Preferably, there is also provided a resilient locking-type washer 80 between the forward end of the ferrule 22 of the arrow shaft 24 and at least the rear surface 63 of the deformable collar 60, or of the last intermediate weight washer 70, so as to frictionally lock the parts together once the broadhead arrowhead 20 shown in FIG. I is screwed onto the end of the arrow shaft 24. This resilient washer 80 resists the easy unscrewing of the arrowhead 20, reducing its changes of being lost or damaged. This washer 80 is preferably provided with beveled outer edges 81 so that in its compression it will fill in these beveled edges to form a substantially smooth cylindrical surface from the base 63 of the collar 60 to the cylindrical outer surface of the arrow shaft 24.

This resilient washer may be made of rubber or other resilient plastic, and has the additional advantage of being able to permit easy angular adjustment of the blades 40 with respect to the nock at the rear end of the arrow shaft 24 for aiding in sighting of the arrow by the hunter or user thereof, without materially loosening the parts of the broadhead arrowhead 20 in its assembled attachment to the forward end of the arrow shaft 24.

G. The Assembly

In assembling the parts of the broadhead arrow of this invention, namely the parts as shown in FIG. II, the threaded portion 52 of the tip 50 is first screwed into the socket at the front end of the shaft portion 30, and then the blades 40, 40' or devices 140, 140' or 240 are placed in the slots 33 with their forward ends 41, 141 and 241 slipped up into the groove 55 or 55' inside the peripheral base 53 of the tip 50. Once all of the blades 40, 40' or devices 140, 140' or 240 are inserted into their slots 33, the deformable collar 60 is then slipped over the rear end of the shaft portion 31 so that its forward end 61 fits over each of the rearward acute angle projections 45, 145 or 245 of the devices and/or into each of the notches 44 of the blades 40 or 40'. Then the arrowhead assembly as shown in FIG. I may be directly screwed into the ferrule 22 at the front end of the arrow shaft 24 and tightened to deform the collar 60. Then the threaded shank 36 is unscrewed from the ferrule 22 and a locking washer 80 is placed on the shank 35 and the shank 36 is rescrewed into the ferrule 22 permitting its easy angular adjustment and frictional holding of the parts more firmly together. If a change in the weight and/or balance of the arrow is desired, one or more of the weight washers 70 may be inserted between the collar 60 and locking washer 80 as shown in FIG. III. However, to avoid cutting one's fingers in screwing and unscrewing the assembled broadhead shown in FIG. I into and out of the end of the arrow shaft 24, it is advisable that a cloth or guard be wrapped around the arrowhead 20.

Once the arrowhead 20 is unscrewed from the arrow shaft 24, the blades 40, 40' and devices 140, 140' and 240 may be easily removed by hand by axially sliding the retaining collar 60 off the shaft 35 and lifting the bases 43, 143 and 243 of the blades or devices out of the slots 33. However, pliers may have to be used, and particularly if the forward projections 41, 141 and 241 are deformed as at 42.

H. Conclusions

It is to be understood that other materials than those above mentioned may be employed for any of the parts, including other metals, and alloys, and in some instances, even plastics.

Although only four blades or devices are shown in four separate four slots in the broadhead arrowhead 20 of this disclosure, it is to be understood that any number of slots and blades or devices may be provided without departing from the scope of this invention. Furthermore, any one or more of the blades or devices may be interchanged with other blades and devices, and so may the different tips 50, without departing from the scope of this invention.

While there is described above the principles of this invention is connection with specific apparati, it is to be clearly understood that this description is made only by way of example and not as a limitation of the scope of this invention.

I claim:

1. A broadhead arrowhead comprising:

(A) a central shaft portion having at least one axially extending slot in a plane spaced radially from and parallel to the axis of said shaft portion, (B) a device seatable in said slot having a notch at its rear end, and (C) a deformable washer fitable in said notch for anchoring and locking the rear end of said device in said slot.

2. An arrowhead according to claim 1 having a plurality of said slots equally angularly spaced around said shaft portion.

3. An arrowhead according to claim 2 wherein said plurality of devices and slots are each four in number.

4. An arrowhead according to claim 1 wherein said shaft portion includes an externally threaded rear end for threading into an arrow shaft.

5. An arrowhead according to claim 4 wherein the threaded rear end has an intermediate annular groove for shortening the length of said threaded end.

6. An arrowhead according to claim 1 wherein said shaft portion includes an internally threaded portion, and said arrowhead includes a tip means threaded into said internally threaded portion for anchoring and locking the front end of said device.

7. An arrowhead according to claim 6 wherein said tip means has a groove into which the forward end of said device is inserted.

8. An arrowhead according to claim 7 wherein said forward end is deformed in said groove.

9. An arrowhead according to claim 1 wherein said at least one slot extends out the forward end of said shaft portion and is spaced from the rearward end of said shaft portion.

10. An arrowhead according to claim 1 wherein the device that seats in said slot extends slightly beyond the front end of said slot.

11. An arrowhead according to claim 1 wherein said device is a blade.

12. An arrowhead according to claim 11 wherein said blade has a sharpened outer edge.

13. An arrowhead according to claim 11 wherein said blade is anchored and locked at both ends of said slots.

14. An arrowhead according to claim 1 wherein said shaft portion includes a rear shank portion and washer means on said portion.

15. An arrowhead according to claim 14 wherein said washer means comprises a weight.

16. An arrowhead according to claim 14 wherein said washer means comprises a resilient locking washer for adjusting the angle of the blades with respect to the nock at the end of the arrow shaft.

17. A broadhead arrowhead comprising:

(A) a central shaft portion having at least one axially extending slot in a plane spaced radially from and parallel to the axis of said shaft portion, (B) a wire device seatable in said slot, and (C) means for anchoring said device in both ends of said slot.

18. An arrowhead according to claim 17 wherein said wire device has a flexible line connection.

19. An arrowhead according to claim 17 wherein said wire device comprises a wire loop.

20. A broadhead arrowhead comprising:

(A) a central shaft portion having at least one axially extending slot open at its forward end, (B) a bendable blade seatable in said slot and having a forward end extending out of said forward end of said slot, and (C) tip means having an annular groove for engaging and bending said forward end of said blade out of the common plane of said slot and blade for anchoring said blade in said slot.

21. An arrowhead according to claim 20 wherein said blade has a sharpened outer edge.

22. An arrowhead according to claim 20 including a plurality of said blades in a plurality of said slots equally angularly spaced around said shaft portion.

23. A broadhead arrowhead comprising:

(A) a central shaft portion having a plurality of axially extending slots in planes spaced radially from the axis of said shaft portion, (B) a plurality of devices seatable in said slots, (C) a tip attached to the front end of said shaft portion and overlying the front ends of said devices, and (D) a deformable annular collar axially slidably mounted around the rear end of said shaft portion overlapping the rear ends of said devices, said collar having a frusto-conical outer surface bridging the difference in diameters between said central shaft portion and the arrowhead shaft to which said arrowhead is attached.

24. An arrowhead according to claim 23 wherein said central shaft portion has an externally threaded rear shank for threading into an arrow shaft around which shank said deformable collar fits.

25. An arrowhead according to claim 24 wherein said devices are blades.

26. An arrowhead according to claim 25 including a resilient washer axially slidably mounted between the said collar and the front end of an arrow shaft for permitting angular adjustment of said blades with respect to the arrow shaft after said collar is axially urged into deformable contact with the rear of said blades by tightening the threads of said shank into said front end of the arrow shaft.

27. An arrowhead according to claim 23 wherein said devices have acute angle projections at each end thereof for engagement with said tip and said deformable collar.

28. An arrowhead according to claim 23 wherein said tip has an annular groove for seating the forward ends of said devices.

29. An arrowhead according to claim 28 wherein said groove deforms the forward ends of said devices.

30. An arrowhead according to claim 23 including a weight washer on said shank between said collar and the front end of the arrow shaft for tuning the arrow.

31. A broadhead arrowhead comprising:

(A) a central shaft portion externally threaded at its rear end for threading into an arrow shaft, internally threaded at its forward end, and having a plurality of axially extending slots in planes spaced equal radial distances from the axis of said shaft substantially along the central portion of said shaft portion, (B) a plurality of blades seatable in said slots having acute angled projections at each end in said blades, (C) a tip having an annular groove and threaded extension at its rear end for threading into the internal threaded forward end of said shaft portion whereby the front acute angled projections of said blades are anchored in said annular groove, (D) a deformable annular collar axially slidably mounted around the rear end of said shaft portion overlapping the rear acute angled ends of said blades to anchor their rear ends in said slots, and (E) a resilient locking washer axially slidably mounted between said collar and the front end of the arrow shaft for permitting angular adjustment of said blades with respect to said arrow shaft while the collar is axially urged into deformable contact with the rear of said blades by the threading of said externally threaded rear portion of said shaft portion into the front end of said arrow shaft.

* * * * *

UNITED STATES PATENT AND TRADEMARK OFFICE

CERTIFICATE OF CORRECTION

PATENT NO. : 4,210,330

DATED : July 1, 1980

INVENTOR(S) : John V. Kosbab

It is certified that error appears in the above-identified patent and that said Letters Patent are hereby corrected as shown below:

Column 9, Claim 14, line 3, before "portion" insert - - shank - - .

Signed and Sealed this

*Fourteenth* Day of *October 1980*

[SEAL]

*Attest:*

SIDNEY A. DIAMOND

*Attesting Officer*

*Commissioner of Patents and Trademarks*